US007157644B2

(12) United States Patent
Lique et al.

(10) Patent No.: US 7,157,644 B2
(45) Date of Patent: Jan. 2, 2007

(54) REDUCED ALIEN CROSSTALK ELECTRICAL CABLE WITH FILLER ELEMENT

(75) Inventors: Roger Lique, Standford, KY (US); Asef Baddar, Independence, KY (US); Thomas McLaughlin, Taylor Mill, KY (US); Mike Doorhy, Mokena, IL (US); David Hawkins, Sugar Hill, GA (US)

(73) Assignee: General Cable Technology Corporation, Highland Heights, KY (US)

( * ) Notice: Subject to any disclaimer, the term of this patent is extended or adjusted under 35 U.S.C. 154(b) by 0 days.

(21) Appl. No.: 11/012,167

(22) Filed: Dec. 16, 2004

(65) Prior Publication Data

US 2006/0131055 A1 Jun. 22, 2006

(51) Int. Cl.
*H01B 7/00* (2006.01)

(52) U.S. Cl. ..... 174/113 C

(58) Field of Classification Search ..... 174/113 R, 174/113 C, 131 A, 116, 27
See application file for complete search history.

(56) References Cited

U.S. PATENT DOCUMENTS

| | | | | |
|---|---|---|---|---|
| 483,285 | A | 9/1892 | Guilleaume | |
| 1,008,370 | A | 11/1911 | Robillot | |
| 1,654,508 | A | 12/1927 | Boggs | |
| 1,673,752 | A | 6/1928 | Lewis et al. | |
| 1,739,012 | A | 12/1929 | Middleton | |
| 1,780,564 | A | 11/1930 | Oxer | |
| 1,883,269 | A | 10/1932 | Yonkers | |
| 1,976,847 | A | 10/1934 | Gordon et al. | |
| 2,125,869 | A | 8/1938 | Atkinson | |
| 2,455,773 | A | 12/1948 | Johnson | |
| 2,538,019 | A | 1/1951 | Lee | |
| 2,583,026 | A | 1/1952 | Swift | |
| RE24,154 | E | 5/1956 | Krueger | |
| 2,804,494 | A | 9/1957 | Fenton | |
| 2,847,499 | A | 8/1958 | Peterson | |
| 3,005,739 | A | 10/1961 | Lang et al. | |
| 3,032,604 | A | 5/1962 | Timmons | |
| 3,086,557 | A | 4/1963 | Peterson | |
| 3,102,160 | A | 8/1963 | Cook et al. | |
| 3,131,469 | A | 5/1964 | Glaze | |
| 3,209,064 | A | 9/1965 | Cutler | |
| 3,234,722 | A | 2/1966 | Gilmore | |
| 3,263,024 | A | 7/1966 | Hirsch | |
| 3,274,329 | A | 9/1966 | Timmons | |
| 3,324,233 | A | 6/1967 | Bryant | |
| 3,622,683 | A | 11/1971 | Roberts et al. | |
| 3,644,659 | A * | 2/1972 | Campbell | 174/27 |
| 3,649,434 | A | 3/1972 | Mortenson | |

(Continued)

FOREIGN PATENT DOCUMENTS

| | | |
|---|---|---|
| EP | 0 302 162 | 4/1995 |

(Continued)

*Primary Examiner*—Chau Nguyen N.
(74) *Attorney, Agent, or Firm*—Blank Rome LLP

(57) ABSTRACT

An electrical cable includes a cable jacket defining a central longitudinal axis and a plurality of twisted pairs of insulated conductors oriented longitudinally within the cable jacket. Each of the twisted pairs of insulated conductors has a width. A filler element is disposed in the cable jacket and is located adjacent to at least one of the twisted pairs of insulated conductors. The filler element defines a width that is substantially larger than the width of each the twisted pairs of insulated conductors. The filler element has a central axis laterally offset from the central longitudinal axis of the cable jacket. The filler element reduces alien crosstalk from an adjacent cable.

25 Claims, 2 Drawing Sheets

U.S. PATENT DOCUMENTS

| | | | | |
|---|---|---|---|---|
| 3,649,744 | A | 3/1972 | Coleman | |
| 3,650,862 | A | 3/1972 | Burr | |
| 3,678,177 | A | 7/1972 | Lawrenson | |
| 3,715,458 | A | 2/1973 | Bayes et al. | |
| 3,761,842 | A | 9/1973 | Gandrud | |
| 3,803,340 | A | 4/1974 | Jachimowiczm et al. | |
| 3,843,831 | A | 10/1974 | Hutchison et al. | |
| 3,881,052 | A | 4/1975 | Britz et al. | |
| 3,911,200 | A | 10/1975 | Simons et al. | |
| 3,921,381 | A | 11/1975 | Vogelsberg | |
| 4,010,213 | A | 3/1977 | Naegeli | |
| 4,034,148 | A | 7/1977 | Lang | |
| 4,041,237 | A | 8/1977 | Stine et al. | |
| 4,081,602 | A | 3/1978 | Paniri et al. | |
| 4,085,284 | A | 4/1978 | Olszewski et al. | |
| 4,096,346 | A | 6/1978 | Stine et al. | |
| 4,110,554 | A | 8/1978 | Moore et al. | |
| 4,131,690 | A | 12/1978 | Jukes et al. | |
| 4,165,442 | A | 8/1979 | Gabriel et al. | |
| 4,218,581 | A | 8/1980 | Suzuki | |
| 4,234,759 | A | 11/1980 | Harlow | |
| 4,262,164 | A | 4/1981 | Nutt et al. | |
| 4,319,940 | A | 3/1982 | Arroyo et al. | |
| 4,340,771 | A | 7/1982 | Watts | |
| 4,356,345 | A | 10/1982 | Gonia | |
| 4,368,214 | A | 1/1983 | Gillette | |
| 4,393,582 | A | 7/1983 | Arnold, Jr. et al. | |
| 4,394,705 | A | 7/1983 | Blachman | |
| 4,404,424 | A | 9/1983 | King et al. | |
| 4,412,094 | A | 10/1983 | Dougherty et al. | |
| 4,449,012 | A | 5/1984 | Voser | |
| 4,453,031 | A | 6/1984 | Justiss | |
| 4,467,138 | A | 8/1984 | Brorein | |
| 4,468,089 | A | 8/1984 | Brorein | |
| 4,481,379 | A | 11/1984 | Bolick, Jr. et al. | |
| 4,486,619 | A | 12/1984 | Trine et al. | |
| 4,487,992 | A | 12/1984 | Tomita | |
| 4,500,748 | A | 2/1985 | Klein | |
| 4,515,993 | A | 5/1985 | MacKenzie | |
| 4,541,980 | A | 9/1985 | Kiersarsky et al. | |
| 4,550,559 | A | 11/1985 | Thomson | |
| 4,552,432 | A | 11/1985 | Anderson et al. | |
| 4,588,852 | A | 5/1986 | Fetterolf et al. | |
| 4,595,793 | A | 6/1986 | Arroyo et al. | |
| 4,605,818 | A | 8/1986 | Arroyo et al. | |
| 4,697,051 | A | 9/1987 | Beggs et al. | |
| 4,711,811 | A | 12/1987 | Randa | |
| 4,755,629 | A * | 7/1988 | Beggs et al. | 174/34 |
| 4,767,890 | A | 8/1988 | Magnan | |
| 4,777,325 | A | 10/1988 | Siwinski | |
| 4,800,236 | A | 1/1989 | Lemke | |
| 4,873,393 | A | 10/1989 | Friesen et al. | |
| 4,933,513 | A | 6/1990 | Lee | |
| 4,941,729 | A | 7/1990 | Hardin et al. | |
| 4,963,609 | A | 10/1990 | Anderson et al. | |
| 5,010,210 | A | 4/1991 | Sidi et al. | |
| 5,015,800 | A | 5/1991 | Vaupotic et al. | |
| 5,103,067 | A | 4/1992 | Aldissi | |
| 5,110,999 | A | 5/1992 | Barbera | |
| 5,132,488 | A | 7/1992 | Tessier et al. | |
| 5,142,100 | A | 8/1992 | Vaupotic | |
| 5,162,609 | A | 11/1992 | Adriaenssens et al. | |
| 5,202,946 | A | 4/1993 | Hardin et al. | |
| 5,245,134 | A | 9/1993 | Vana, Jr. et al. | |
| 5,253,317 | A | 10/1993 | Allen et al. | |
| 5,283,390 | A | 2/1994 | Hubis et al. | |
| 5,286,923 | A | 2/1994 | Prudhon et al. | |
| 5,298,680 | A | 3/1994 | Kenny | |
| 5,342,991 | A | 8/1994 | Xu et al. | |
| 5,367,971 | A | 11/1994 | Carpenter et al. | |
| 5,376,758 | A | 12/1994 | Kimber | |
| 5,393,933 | A | 2/1995 | Goertz | |
| 5,399,813 | A | 3/1995 | McNeill et al. | |
| 5,401,908 | A | 3/1995 | Rodeghero | |
| 5,424,491 | A | 6/1995 | Walling et al. | |
| 5,434,354 | A | 7/1995 | Baker et al. | |
| 5,448,669 | A * | 9/1995 | Dunn et al. | 385/101 |
| 5,483,020 | A | 1/1996 | Haedie et al. | |
| 5,493,071 | A | 2/1996 | Newmoyer | |
| 5,514,837 | A | 5/1996 | Kenny et al. | |
| 5,519,173 | A | 5/1996 | Newmoyer et al. | |
| 5,525,757 | A | 6/1996 | O'Brien | |
| 5,541,361 | A | 7/1996 | Friesen et al. | |
| 5,544,270 | A | 8/1996 | Clark et al. | |
| 5,574,250 | A | 11/1996 | Hardie et al. | |
| 5,606,151 | A | 2/1997 | Siekierka et al. | |
| 5,734,126 | A | 3/1998 | Siekierka et al. | |
| 5,742,002 | A | 4/1998 | Arredondo et al. | |
| 5,744,757 | A | 4/1998 | Kenny et al. | |
| 5,767,441 | A | 6/1998 | Brorein et al. | |
| 5,770,820 | A | 6/1998 | Nelson et al. | |
| 5,789,711 | A | 8/1998 | Gaeris et al. | |
| 5,814,768 | A | 9/1998 | Wessels et al. | |
| 5,821,466 | A | 10/1998 | Clark et al. | |
| 5,834,697 | A | 11/1998 | Baker et al. | |
| 5,883,334 | A * | 3/1999 | Newmoyer et al. | 174/113 R |
| 5,900,588 | A | 5/1999 | Springer et al. | |
| 5,932,847 | A | 8/1999 | Mayfield | |
| 5,936,205 | A | 8/1999 | Newmoyer | |
| 5,952,607 | A | 9/1999 | Friesen et al. | |
| 5,952,615 | A | 9/1999 | Prudhon | |
| 5,956,445 | A | 9/1999 | Deitz, Sr. et al. | |
| 5,969,295 | A | 10/1999 | Boucino et al. | |
| 5,990,419 | A | 11/1999 | Bogese, II | |
| 6,037,546 | A | 3/2000 | Mottine et al. | |
| 6,064,008 | A | 5/2000 | Craton | |
| 6,066,799 | A | 5/2000 | Nugent | |
| 6,074,503 | A | 6/2000 | Clark et al. | |
| 6,091,025 | A | 7/2000 | Cotter et al. | |
| 6,101,305 | A | 8/2000 | Wagman et al. | |
| 6,139,957 | A | 10/2000 | Craton | |
| 6,140,587 | A | 10/2000 | Sackett | |
| 6,150,612 | A | 11/2000 | Grandy et al. | |
| 6,153,826 | A | 11/2000 | Kenny et al. | |
| 6,162,992 | A | 12/2000 | Clark et al. | |
| 6,194,663 | B1 | 2/2001 | Friesen et al. | |
| 6,211,467 | B1 | 4/2001 | Berelsman et al. | |
| 6,222,129 | B1 | 4/2001 | Siekierka et al. | |
| 6,222,130 | B1 | 4/2001 | Gareis et al. | |
| 6,239,379 | B1 | 5/2001 | Cotter et al. | |
| 6,248,954 | B1 | 6/2001 | Clark et al. | |
| 6,255,593 | B1 | 7/2001 | Reede | |
| 6,259,031 | B1 | 7/2001 | Totland et al. | |
| 6,288,340 | B1 | 9/2001 | Arnold | |
| 6,297,454 | B1 | 10/2001 | Gareis | |
| 6,300,573 | B1 | 10/2001 | Horie et al. | |
| 6,310,295 | B1 | 10/2001 | Despard | |
| 6,323,427 | B1 | 11/2001 | Rutledge | |
| 6,342,678 | B1 * | 1/2002 | Knop et al. | 174/113 C |
| 6,353,177 | B1 | 3/2002 | Young | |
| 6,365,836 | B1 | 4/2002 | Blouin et al. | |
| 6,433,272 | B1 | 8/2002 | Buhler et al. | |
| 6,448,500 | B1 | 9/2002 | Hosaka et al. | |
| 6,452,105 | B1 | 9/2002 | Badii et al. | |
| 6,462,268 | B1 | 10/2002 | Hazy et al. | |
| 6,465,737 | B1 | 10/2002 | Bonato et al. | |
| 6,476,326 | B1 | 11/2002 | Fuzier et al. | |
| 6,506,976 | B1 | 1/2003 | Neveux, Jr. | |
| 6,534,715 | B1 | 3/2003 | Maunder et al. | |
| 6,545,222 | B1 | 4/2003 | Yokokawa et al. | |
| 6,566,605 | B1 | 5/2003 | Prudhon | |
| 6,566,607 | B1 | 5/2003 | Walling | |
| 6,570,095 | B1 | 5/2003 | Clark et al. | |
| 6,573,456 | B1 | 6/2003 | Spruell et al. | |

| | | | | |
|---|---|---|---|---|
| 6,596,944 | B1 | 7/2003 | Clark et al. | |
| 6,624,359 | B1 | 9/2003 | Bahlmann et al. | |
| 6,639,152 | B1 | 10/2003 | Glew et al. | |
| 6,687,437 | B1 | 2/2004 | Starnes et al. | |
| 6,710,243 | B1 | 3/2004 | Kao | |
| 6,713,673 | B1 | 3/2004 | Kao | |
| 6,743,983 | B1 | 6/2004 | Wiekhorst et al. | |
| 6,770,819 | B1 | 8/2004 | Patel | |
| 6,787,697 | B1 | 9/2004 | Stipes et al. | |
| 6,800,811 | B1 | 10/2004 | Boucino | |
| 6,812,408 | B1 | 11/2004 | Clark et al. | |
| 6,818,832 | B1 | 11/2004 | Hopkinson et al. | |
| 6,855,889 | B1 | 2/2005 | Gareis | |
| 6,875,928 | B1 | 4/2005 | Hayes et al. | |
| 6,888,070 | B1 | 5/2005 | Prescott | |
| 2001/0001426 | A1 | 5/2001 | Gareis et al. | |
| 2001/0040042 | A1 | 11/2001 | Stipes | |
| 2002/0079126 | A1 | 6/2002 | Valenzuela | |
| 2003/0070831 | A1 | 4/2003 | Hudson | |
| 2003/0106704 | A1 | 6/2003 | Isley et al. | |
| 2003/0121695 | A1 | 7/2003 | Wiebelhaus et al. | |
| 2003/0132021 | A1 | 7/2003 | Gareis | |
| 2003/0205402 | A1 | 11/2003 | Koyasu et al. | |
| 2003/0217863 | A1 | 11/2003 | Clark et al. | |
| 2003/0230427 | A1 | 12/2003 | Gareis | |
| 2004/0035603 | A1 | 2/2004 | Clark et al. | |
| 2004/0050578 | A1 | 3/2004 | Hudson | |
| 2004/0055777 | A1 | 3/2004 | Wiekhorst et al. | |
| 2004/0055779 | A1 | 3/2004 | Wiekhorst et al. | |
| 2004/0055781 | A1 | 3/2004 | Cornibert et al. | |
| 2004/0118593 | A1 | 6/2004 | Augustine et al. | |
| 2004/0149483 | A1 | 8/2004 | Glew | |
| 2004/0149484 | A1* | 8/2004 | Clark | 174/113 R |
| 2004/0256139 | A1 | 12/2004 | Clark | |
| 2005/0006132 | A1* | 1/2005 | Clark | 174/113 C |
| 2005/0023028 | A1 | 2/2005 | Clark | |
| 2005/0029007 | A1 | 2/2005 | Nordin et al. | |
| 2005/0045367 | A1 | 3/2005 | Somers et al. | |
| 2005/0051355 | A1 | 3/2005 | Bricker et al. | |
| 2005/0087360 | A1 | 4/2005 | Speer | |
| 2005/0092514 | A1 | 5/2005 | Kenny et al. | |
| 2005/0092515 | A1 | 5/2005 | Kenny et al. | |
| 2005/0103518 | A1 | 5/2005 | Glew | |
| 2005/0167149 | A1 | 8/2005 | Prescott | |
| 2005/0167151 | A1 | 8/2005 | Kenny et al. | |
| 2005/0189135 | A1 | 9/2005 | Clark | |
| 2005/0199415 | A1 | 9/2005 | Glew | |
| 2005/0205289 | A1 | 9/2005 | Kenny et al. | |

FOREIGN PATENT DOCUMENTS

| | | |
|---|---|---|
| FR | 694100 | 11/1930 |
| GB | 1 390 152 | 4/1975 |
| GB | 2 120 836 A | 12/1983 |
| JP | 06349344 A | 12/1994 |

* cited by examiner

REDUCED ALIEN CROSSTALK ELECTRICAL CABLE WITH FILLER ELEMENT

FIELD OF THE INVENTION

The present invention relates to an electrical cable that reduces alien crosstalk between cables. More specifically, a filler element disposed in the electrical cable reduces alien crosstalk between adjacent cables.

BACKGROUND OF THE INVENTION

Interference between electrical cables bundled together in a cabling system decreases the efficiency of data transmission by the cabling system. Alien near-end crosstalk (ANEXT) and alien far-end crosstalk (AFEXT) noise is caused by the electrical unbalance between the twisted pairs of insulated conductors of adjacent cables. ANEXT and AFEXT are transmission noises that can increase the signal to noise ratio (SNR) and bit error rate (BER) in a cable transmission system, such as for a local area network.

Specifically, ANEXT and AFEXT occur when some of the signal current in a twisted pair of one cable couples with another twisted pair of another cable external to the signal path and along the path of a circuit between the two pairs. That noise corrupts the signal in the twisted pair external to the original signal path. When the circuit between the noise emitting and receiving twisted pairs egresses one cable boundary and crosses another cable boundary, the noise becomes alien crosstalk.

SUMMARY OF THE INVENTION

According to the present invention, there is provided an electrical cable that includes a cable jacket defining a central longitudinal axis and a plurality of twisted pairs of insulated conductors oriented longitudinally within the cable jacket. Each of the twisted pairs of insulated conductors has a width. A filler element is disposed in the cable jacket and is located adjacent to at least one of the twisted pairs of insulated conductors. The filler element defines a width that is substantially larger than the width of each the twisted pairs of insulated conductors. The filler element has a central axis laterally offset from the central longitudinal axis of the cable jacket. The filler element reduces alien crosstalk from an adjacent cable.

The present invention also provides an electrical cable that includes a cable jacket that defines a central longitudinal axis and a substantially non-circular outer perimeter. A plurality of twisted pairs of insulated conductors are oriented longitudinally within the cable jacket. Each of the twisted pairs of insulated conductors has a width. A filler element is disposed in the cable jacket and located adjacent to at least one of the twisted pairs of insulated conductors. The filler element has a central axis laterally offset from the central longitudinal axis of the cable jacket. The filler element is substantially circular in section transverse to the central axis and defines a diameter that is substantially larger than the width of each the twisted pairs of insulated conductors. The filler element reduces alien crosstalk from an adjacent cable.

Advantages and salient features of the invention will become apparent from the following detailed description, which, taken in conjunction with the annexed drawings, discloses preferred embodiments of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
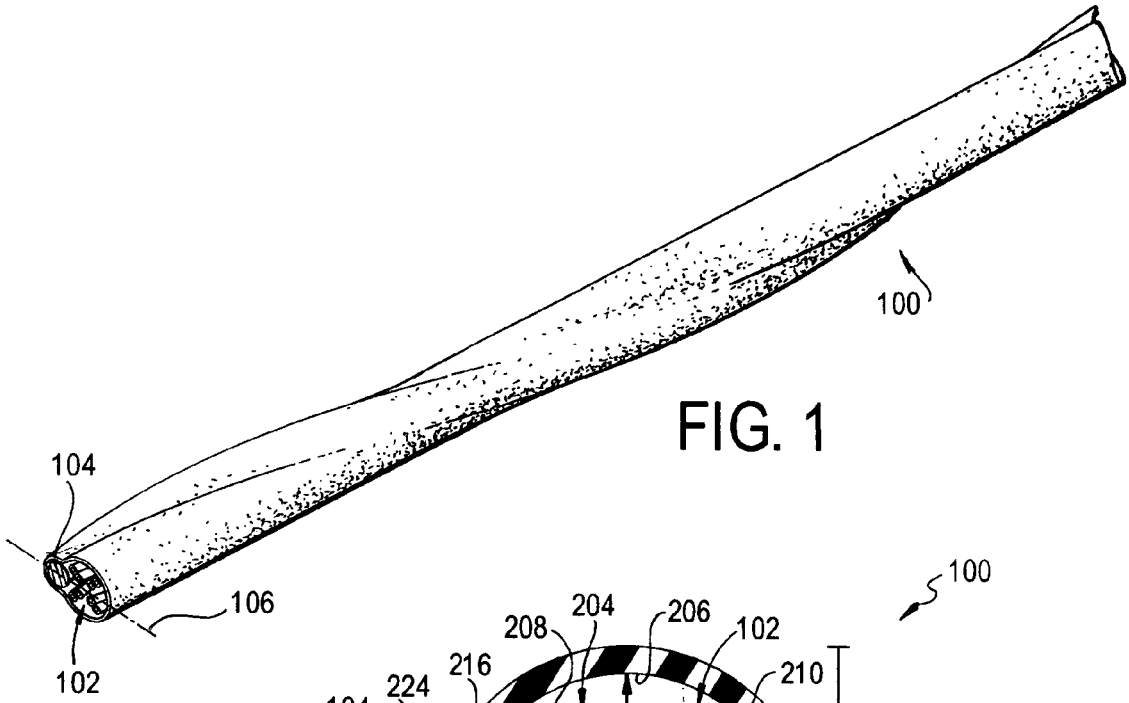
FIG. 1 is a drawing of a perspective view of an electrical cable according to a first embodiment of the present invention.
Figure 2:
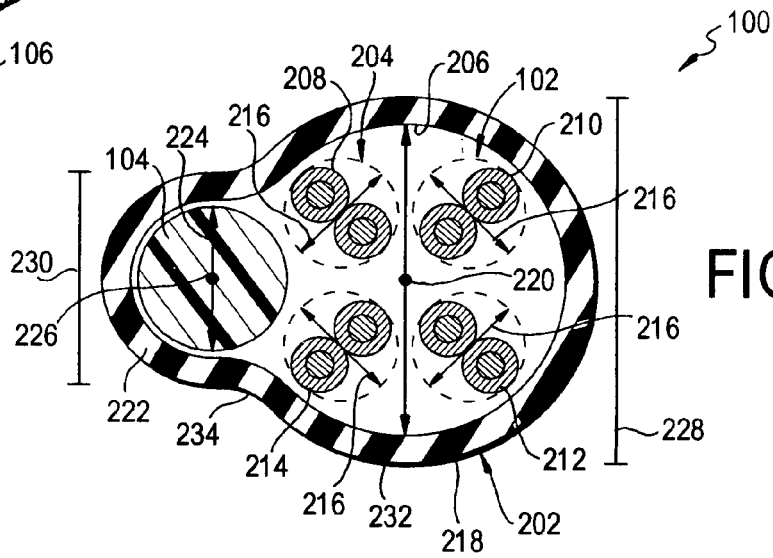
FIG. 2 is a drawing of an elevational view in section of the electrical cable illustrated in FIG. 1, showing a plurality of twisted pairs of insulated conductors and a filler element enclosed by a cable jacket.

Referring to FIGS. 1 and 2, an electrical cable 100 according to a first embodiment of the present invention includes a plurality of twisted pairs of insulated conductors 102 and a filler element 104 for reducing alien crosstalk between adjacent cables. More specifically, the filler element 104 increases the cable diameter along one axis 106 of the cable 100 cross-section, effectively increasing the net distance between the pairs of insulated conductors 102 in the cable 100 from twisted pairs of insulated conductors of an adjacent cable (not shown).

As seen in FIG. 2, the electrical cable 100 has a cable jacket 202 that encloses the filler element 104 and the plurality of twisted pairs of insulated conductors 102 in an inner area 204 defined by the inner perimeter 206 of the cable jacket 202. Although the plurality of twisted pairs of insulated conductors 102 preferably include four pairs of insulated conductors 208, 210, 212, and 214, the electrical cable 100 can include any number of twisted pairs of insulated conductors. The cable jacket 202 can be formed of a dielectric material, such as PVC, TA-910, or polyolefin low smoke zero halogen.

Each twisted pair of insulated conductors 208, 210, 212, and 214 defines a width 216 and is supported in a first region 218 of the cablejacket 202. The cable jacket 202 defines a generally central longitudinal axis 220. The cable 100 can be twisted about the central longitudinal axis 220, as seen in FIG. 1. A second region 222 supports the filler element 104. The filler element 104 has a generally cylindrical rod shape, with a substantially circular cross-sectional shape, and defines a width or diameter 224 and has a central axis 226. The first and second regions 218 and 222 are generally continuous.

The width 228 of the first region 218 is substantially larger than the width 230 of the second region 222, thereby creating an uneven or lopsided outer perimeter 232 of the cable jacket 202, such that the shape of the electrical connector 100 in section transverse to the longitudinal axis 220 is substantially non-circular, as seen in FIG. 2. Preferably, the width 228 of the first region 218 is about twice the width 230 of the second region 222. However, the width 228 of the first region 218 can be any size with respect to width 230 of the second region 222, such as the same as or slightly larger than the width 230 of the second region 222, as long as the first region 218 can accommodate the twisted pairs of insulated conductors 102 and the second region 222 can accommodate the filler element 104. The outer perimeter 232 is asymmetrical and defines a transition area 234 between the larger first region 218 and the smaller second region 222. As seen in FIG. 1, the filler element 104 twists around the pairs 208, 210, 212, and 214 which form a core.

The width 224 of the filler element 104 is substantially larger than the width 216 of each of the twisted pairs of insulated conductors 208,210,212 and 214. The central axis 226 of the filler element 104 is laterally offset from the central longitudinal axis 220 of the cable 100. By offsetting the axes 220 and 226 of the cable 100 and the filler element 104, respectively, and due to the size of the filler element 104, the diameter of the cable 100 along the axis 106 is increased.

Because the width 224 of the filler element 104 is larger than the width 216 of the individual pairs of insulated conductors 208, 210, 212 and 214, and larger than at least the width of the insulated conductors themselves, the pairs 208, 219, 212 and 214 are prevented from encircling the filler element 104, thereby preventing coaxial alignment of the central axis 226 of the filler element 104 and the central longitudinal axis 220 of the electrical cable 100. Thus the non-circular cross-sectional shape of the electrical cable 100 is maintained. The lopsided shape and the increased diameter along the axis 106 of the electrical cable reduces alien crosstalk between adjacent cables 100 by increasing the distance from the twisted pairs of insulated conductors of the adjacent cables 100.

Figure 3:
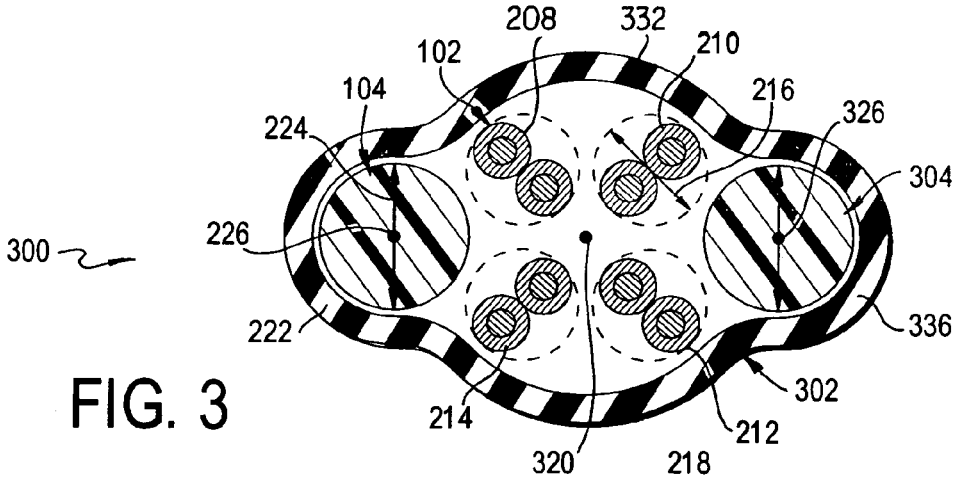
FIG. 3 is a drawing of an elevational view in section of an electrical cable according to a second embodiment of the present invention.

Referring to FIG. 3, an electrical cable 300 in accordance with a second embodiment of the present invention is the same as the electrical cable 100 of the first embodiment, except a second filler element 304 is disposed in a third region 336 of the cable jacket 302. The third region 336 is substantially the same size as the second region 222 and the second filler element 304 is substantially the same size as the first filler element 104. The outer perimeter 332 of the cable jacket 302 is uneven with a non-circular cross-section; however, unlike the first embodiment, the outer perimeter is substantially symmetrical about a vertical axis of FIG. 3. Like the filler element 104, the second filler element 304 has a central axis 326 that is offset from the central longitudinal axis 320 of the cable 300. The second filler element 304 further increases the distance between neighboring cables along axis 106 to reduce alien crosstalk caused by an adjacent cable.

Figure 4:
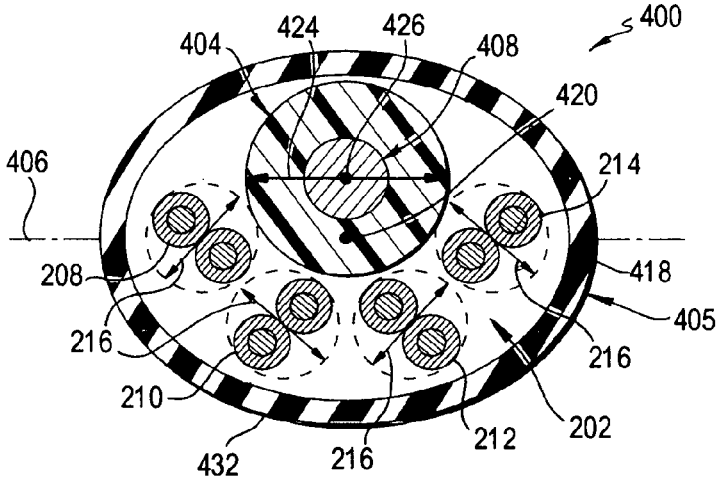
FIG. 4 is a drawing of an elevational view in section of an electrical cable according to a third embodiment of the present invention.

Referring to FIG. 4, an electrical cable 400 in accordance with a fourth embodiment of the present invention includes a filler element 404 and the plurality of twisted pairs of insulated conductors 202 supported in a cable jacket 405. The filler element 404 is similar to the filler element 104, except that it is larger, preferably about twice the width 216 of each twisted pair of insulated conductors 208, 210, 212 and 214. Unlike the cables 100 and 300 of the first and second embodiments, the cable jacket 405 of the cable 400 includes a single region 418 for supporting the filler element 404 and the plurality of twisted pairs 202. The filler element 404 also includes a conductive core 408.

Like the cables 100 and 300 of the first and second embodiments, the cross-sectional shape of the cable 400 is non-circular, such as an elliptical shape. The non-circular shape of the cable 400 defines an even outer perimeter 432 of the cable jacket 406. The non-circular cross-sectional shape of the cable jacket 406 increases the diameter of the cable 400 along one axis 406 of the cable 400. A central axis 426 of the filler element 404 is offset from the central longitudinal axis 420 of the cable 400. Since the width or diameter 424 of the filler element 404 is about twice the width 216 of each twisted pair of insulated conductors 208, 210, 212, and 214, the pairs 208, 210, 212, and 214 are prevented from encircling the filler element 404, so that the filler element 404 remains offset from the central longitudinal axis 420 of the cable 400. Similar to the first and second embodiments, by fashioning the cable 400 in this manner, the distance between twisted pairs of insulated conductors of adjacent cables is increased, thereby reducing alien crosstalk.

While particular embodiments have been chosen to illustrate the invention, it will be understood by those skilled in the art that various changes and modifications can be made therein without departing from the scope of the invention as defined in the appended claims. For example, any number of filler elements can be employed with the cable including one, two, or more than two filler elements.

What is claimed is:

1. An electrical cable, comprising:

a cable jacket defining a central longitudinal axis;

a plurality of twisted pairs of insulated conductors oriented longitudinally within said cable jacket, each of said insulated conductors defining a width, and said plurality of twisted pairs of insulated conductors including at least three twisted pairs of insulated conductors forming a core; and a filler element disposed in said cable jacket and located adjacent to at least one of said twisted pairs of insulated conductors and adjacent to a portion of said cable jacket with no twisted pair of insulated conductors being disposed between said portion of said cable jacket and said filler element, said filler element defining a width that is larger than said width of each of said insulated conductors, said filler element having a central axis laterally offset from said central longitudinal axis of said cable jacket, said filler element being twisted around said core, and said filler element being devoid of any twisted pair of insulated conductors.

2. An electrical cable according to claim 1, wherein said cable jacket defines an outer perimeter that is substantially non-circular in section transverse to said central longitudinal axis.

3. An electrical cable according to claim 2, wherein said outer perimeter is substantially elliptical in section transverse to said central longitudinal axis.

4. An electrical cable according to claim 2, wherein said outer perimeter includes first and second regions, said first region being larger than said second region such that said outer perimeter is uneven.

5. An electrical cable according to claim 4, wherein said plurality of twisted pairs of insulated conductors are disposed in said first region; and said filler element is disposed in said second region.

6. An electrical cable according to claim 4, wherein said outer perimeter includes a third region, said first region being larger than said third region.

7. An electrical cable according to claim 6, wherein said first region is disposed between said second and third regions.

8. An electrical cable according to claim 6, wherein said plurality of twisted wire pairs of insulated conductors are disposed in said first region;

said filler element is disposed in said second region; and a second filler element is disposed in said third region.

9. An electrical cable according to claim 1, wherein a second filler element is disposed in said cable jacket.

10. An electrical cable according to claim 9, wherein said second filler element has a central axis laterally offset from said central longitudinal axis of said cable jacket; and said second filler element defines a width that is larger than said width of each of said insulated conductors.

11. An electrical cable according to claim 1, wherein said filler element is substantially circular in section transverse to said central axis of said filler element.

12. An electrical cable according to claim 1, wherein said width of said filler element is about twice said width of each of said insulated conductors.

13. An electrical cable according to claim 1, wherein said cable jacket is twisted about said central longitudinal axis.

14. An electrical cable according to claim 1, wherein said filler element is made of a dielectric material.

15. An electrical cable according to claim 1, wherein said filler element includes a conductive core.

16. An electrical cable, comprising:

a cable jacket defining a central longitudinal axis and a substantially non-circular outer perimeter;

a plurality of twisted pairs of insulated conductors oriented longitudinally within said cable jacket, each of said insulated conductors defining a width, said plurality of twisted pairs of insulated conductors including at least three twisted pairs of insulated conductors forming a core; and a filler element disposed in said cable jacket and located adjacent to at least one of said twisted pairs of insulated conductors and adjacent to a portion of said cable jacket with no twisted pair of insulated conductors being disposed between said portion of said cable jacket and said filler element, said filler element having a central axis laterally offset from said central longitudinal axis of said cable jacket, said filler element being substantially circular in section transverse to said central axis and defining a diameter that is larger than said width of each of said insulated conductors, said filler element being twisted around said core, and said filler element being devoid of any twisted pair of insulated conductors.

17. An electrical cable according to claim 16, wherein said outer perimeter is substantially elliptical in section transverse to said central longitudinal axis.

18. An electrical cable according to claim 16, wherein said outer perimeter is substantially uneven.

19. An electrical cable according to claim 18, wherein said cable jacket includes first and second regions;

said first region supports said plurality of twisted wire pairs and said second region supports said filler element; and said first region is substantially larger than said second region.

20. An electrical cable according to claim 16, wherein said filler element is made of a dielectric material.

21. An electrical cable according to claim 16, wherein said filler element includes a conductive core.

22. An electrical cable according to claim 16, wherein a second filler element is disposed in said cable jacket;

said second filler element has a central axis laterally offset from said central longitudinal axis of said cable jacket; and said second filler element is larger than said width of each of said insulated conductors.

23. An electrical cable, comprising:

a cable jacket defining a central longitudinal axis;

a plurality of twisted pairs of insulated conductors oriented longitudinally within said cable jacket, and said plurality of twisted pairs of insulated conductors including at least three twisted pairs of insulated conductors forming a core; and a filler element disposed in said cable jacket and located adjacent to at least one of said twisted pairs of insulated conductors and adjacent to a portion of said cable jacket with no twisted pair of insulated conductors being disposed between said portion of said cable jacket and said filler element, said filler element having a central axis laterally offset from said central longitudinal axis of said cable jacket, said filler element being twisted around said core, and said filler element being devoid of any twisted pair of insulated conductors.

24. An electrical cable according to claim 23, wherein: an outer perimeter of said cable jacket is non-circular.

25. An electrical cable according to claim 23, wherein said filler element is substantially circular in section transverse to said central axis of said cable jacket.

* * * * *